US010113778B2

(12) United States Patent
Kim et al.

(10) Patent No.: US 10,113,778 B2
(45) Date of Patent: Oct. 30, 2018

(54) CHILLER SYSTEM

(71) Applicant: LG ELECTRONICS INC., Seoul (KR)

(72) Inventors: Cheolmin Kim, Seoul (KR); Jinhee Jeong, Seoul (KR); Jungho Kang, Seoul (KR); Hyunwook Han, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/256,858

(22) Filed: Sep. 6, 2016

(65) Prior Publication Data

US 2017/0227265 A1 Aug. 10, 2017

(30) Foreign Application Priority Data

Feb. 4, 2016 (KR) ..... 10-2016-0014255

(51) Int. Cl.
*F25B 39/04* (2006.01)
*F25B 39/00* (2006.01)
*F25B 41/04* (2006.01)

(52) U.S. Cl.
CPC ..... *F25B 39/00* (2013.01); *F25B 41/04* (2013.01); *F25B 39/04* (2013.01); *F25B 2339/047* (2013.01); *F25B 2600/2503* (2013.01)

(58) Field of Classification Search
CPC .. F25B 39/00; F25B 41/04; F25B 2600/2503; F25B 2339/047; F25B 39/04
See application file for complete search history.

(56) References Cited

U.S. PATENT DOCUMENTS 5,285,653 A * 2/1994 Meloling ..... F25B 41/065 137/192
5,417,078 A * 5/1995 Huenniger ..... F16K 31/30 137/397
5,630,443 A 5/1997 Rosenberg

FOREIGN PATENT DOCUMENTS

JP 3191521 7/2001
KR 10-2014-0048620 4/2014

OTHER PUBLICATIONS

Korean Office Action dated Dec. 2, 2016 issued in Application No. 10-2016-0014255.

* cited by examiner

*Primary Examiner* — Ana Vazquez
(74) *Attorney, Agent, or Firm* — Ked & Associates, LLP

(57) ABSTRACT

A chiller system includes a compressor that compress refrigerant, a condenser that exchanges heat between the refrigerant and a cooling water discharged from the compressor, and a flow adjusting device that is provided to a refrigerant outlet side of the condenser and adjusts refrigerant amount in the inside of the condenser, the flow adjusting device includes, a main body portion that is communicated with a tubing of the outlet side of the condenser, a refrigerant supply tube that extends to the main body portion from the condenser and supplies the refrigerant in the inside of the condenser to the inside of the main body portion, and a flow hole that is formed on the main body portion and is selectively opened and closed according to refrigerant pressure which is input through the refrigerant supply tube.

16 Claims, 8 Drawing Sheets

CHILLER SYSTEM

CROSS-REFERENCE TO RELATED APPLICATIONS

The present application claims priority under 35 U.S.C. § 119 to Korean Patent Application No. 10-2016-0014255, filed on Feb. 4, 2016, whose entire disclosure is hereby incorporated by reference.

BACKGROUND

1. Field

In general, a chiller (also referred to as a "turbo chiller") supplies cold water to a cold water demand source, such as an air conditioning system, a computer server farm, factory equipment, laboratory equipment, etc., and the chiller is characterized by cooling the cold water by means of a heat exchange between cold waters circulating between a refrigeration system and the cold water demand source. The chiller is physically large and can be installed in large-scale buildings, such as an office building, factory, laboratory, or the like.

2. Background

The chiller may include a compressor, an evaporator, a condenser and an expansion valve. The compressor may include an impeller that rotates by a driving force of a driving motor, a shroud in which the impeller is received, and a variable diffuser that converts the kinetic energy of the fluid which is discharged by the rotation of the impeller into pressure energy.

The evaporator and the condenser may have a shell-in-tube structure. Cooling water and cold water (or other fluid) may flow inside the tube, and a refrigerant may be received inside the inner shell.

The cold water may be inputted to and discharged from the evaporator. The heat between the refrigerant and the cold water may be exchanged in the inner portion of the evaporator. The cold water is cooled in the course of passing through the evaporator. In addition, the cooling water may be inputted to and discharged from the condenser. The heat between the refrigerant and the cooling water is exchanged in the inner portion of the condenser. The cooling water is heated in the course of passing through the condenser.

Also, the liquid refrigerant condensed in the inside of the evaporator and the condenser may be maintained at a predetermined required level, and this level of liquid refrigerant may be adjusted through an expansion valve. The liquid refrigerant level may be changed during an initial start-up, during load fluctuations, or when setting temperature variation of the chiller. If the level of the liquid refrigerant in the condenser is not maintained at a constant level, the reliability of the turbo chiller may be decreased. Accordingly, the level of liquid refrigerant in the condenser may be measured, and the level of the liquid refrigerant may be adjusted.

Detecting and adjusting the level of the liquid refrigerant is discussed in Republic of Korea Laid-Open Patent Application No. 10-2014-0048620 (published date: Apr. 24, 2014). In the chiller (turbo chiller) disclosed in the preceding document, a controller directs a plurality of sensors to determine the level of the liquid refrigerant in the condenser, and further controls an expansion valve to adjust the level of the liquid refrigerant in the condenser based on the detected level of the liquid refrigerant. However, since the controller adjusts the expansion valve based on the detected level of the liquid refrigerant, a control stability problem may occur.

In addition, the disclosed chiller may have a high manufacturing cost due to the multiple sensors and the complexity of the controller. The above reference is incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION OF THE EMBODIMENTS

Figure 1:
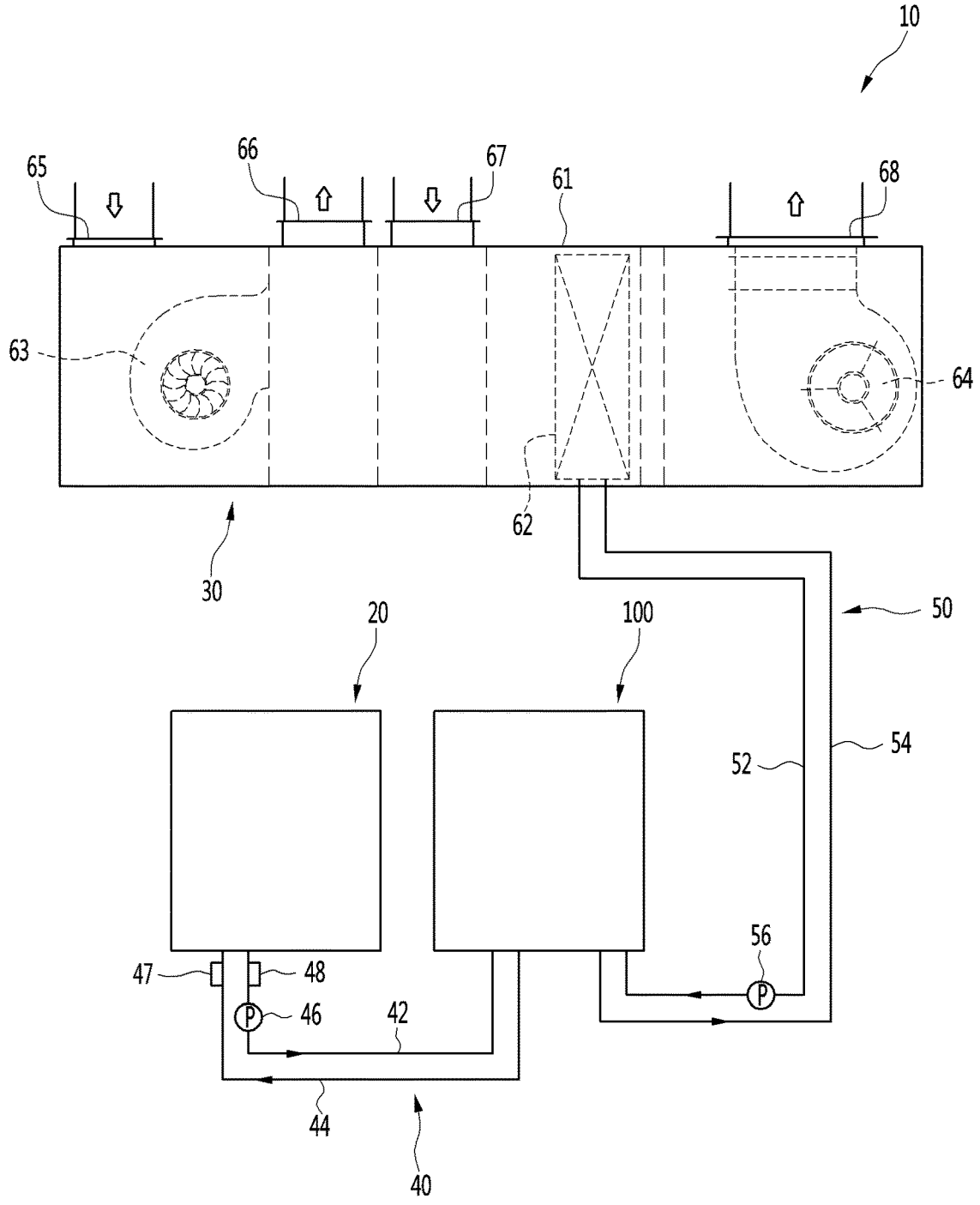
FIG. 1 is a view illustrating a structure of a chiller system according to an embodiment.
Figure 2:
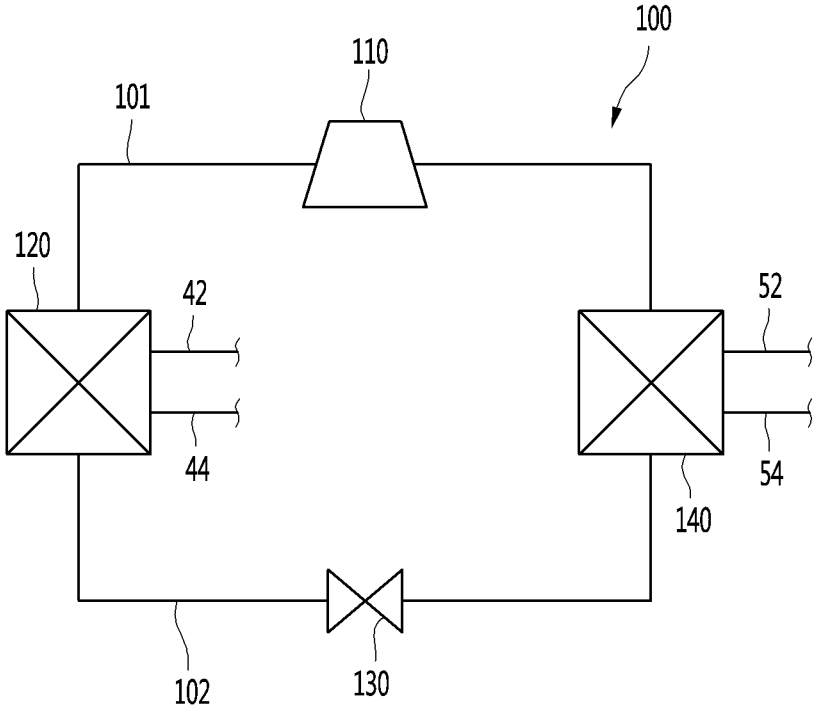
FIG. 2 is a system view illustrating a structure of a chiller module according to an embodiment.

FIG. 1 is a view illustrating a structure of a chiller system according to a first embodiment of the present disclosure, and FIG. 2 is a system view illustrating a structure of a chiller module according to a first embodiment of the present disclosure. With reference to FIGS. 1 and 2, a chiller system 10 according to a first embodiment of the present disclosure may include a chiller module 100 in which a refrigeration cycle is performed, a cooling tower 20 that supplies cooling water to the chiller module 100, and a cold water demand source 30 in which cold water, which is heat exchanged with the chiller module 100, is circulated. The cold water demand source 30 may be a device or a building that performs air conditioning using the cold water.

Between the chiller module 100 and the cooling tower 20, a cooling water circulation flow path 40 may be provided. The cooling water circulation flow path 40 may include tubing that guides the cooling water between the cooling tower 20 and a condenser 120 of the chiller module 100. The cooling water circulation flow path 40 may include a cooling water input flow path 42 that guides the cooling water to be input to the condenser 120 and a cooling water output flow path 44 that guides the cooling water heated at the condenser 120 to flow out to the cooling tower 20.

A cooling pump 46 driving the flow of the cooling water is provided at least one of the cooling water input flow path 42 or the cooling water output flow path 44. As an example, it is illustrated in FIG. 1 that the cooling water pump 46 is provided in the cooling water input flow path 42.

An output water temperature sensor 47 that detects the temperature of the cooling water input into the cooling tower 20 may be provided in the cooling water output flow path 44. Further, an input water temperature sensor 48 that detects the temperature of the cooling water discharged from the cooling tower 20 may be provided in the cooling water input flow path 42.

Between the chiller module 100 and the cold water demand source 30, a cold water circulation flow path 50 may be provided. The cold water circulation flow path 50 may include tubing that guides the cooling water between the cold water demand source 30 and an evaporator 140 of the chiller module 100. The cold water circulation flow path 50 may include a cold water input flow path 52 that guides the cooling water to the evaporator 140, and a cooling water output flow path 54 that guides the cold water cooled at the evaporator 140 to the cold water demand source 30.

A cooling pump 56 driving the flow of the cold water is provided at least one of the cold water input flow path 52 or the cold water output flow path 54. As an example, in FIG. 1, the cold water pump 56 is provided in the cold water input flow path 52.

The cooling water demand source 30 may be a water-cooled air conditioner that exchanges heat between air and the cold water. As an example, the cold water demand source 30 may include an air handling unit (AHU) that mixes the indoor air with outdoor air and then exchanges heat between the mixed air and the cold water and then discharges the cooled air into the interior; a fan coil unit (FCU) that is installed at the interior and exchanges heat between the indoor air and the cold water and then discharges the heat to the interior; or a floor tubing unit that is embedded in the indoor floor.

FIG. 1 is a view illustrating an example of the cold water demand source 30 that includes an AHU. Specifically, the depicted AHU may include a casing 61, a cold water coil 62 that is installed inside the casing 61 and in which the cold water is passed, and first and second ventilators 63 and 64 that are provided proximate to the cold water coil 62. The first ventilator 63 sucks indoor air and outdoor air inside the casing 61, and the second ventilator 64 discharges air-conditioned air (e.g., air that is cooled through a heat exchange with the cold water within to the cold water coil 62) outside of the casing 61.

The casing 61 may include an indoor air sucking portion 65, an indoor air discharging portion 66, an outdoor air sucking portion 67 and air-conditioned discharging portion 68. When the ventilators 63 and 64 are driven, some of the indoor air sucked to the indoor air sucking portion 65 is discharged back indoors through indoor air discharging portion 66, and remaining indoor air that is not discharged to the indoor air discharging portion 66 is mixed with the outdoor air sucked to the outdoor air sucking portion 67 and then exchanges heat with the cold water coil 62. Then, the mixed air that is heat-exchanged with the cold water coil 62 (i.e., cooled) may be discharged to the interior through the air-conditioned air discharging portion 68.

As shown in FIG. 2, the chiller module 100 may include a compressor 110, the condenser 120, an expansion device 130 (also known as an expansion valve or as a refrigerant metering device (RMD)), and the evaporator 140. The compressor 110 may compress a gaseous form of the refrigerant, which heats the gaseous refrigerant. The condenser 120 may receive the compressed, high-temperature refrigerant from the compressor 110 and may perform a heat exchange with the cooling water to cool the refrigerant and convert the refrigerant to a liquid form. The expansion device 130 restricts the flow of the liquid refrigerant from the condenser 120 and reduces the pressure to cool the refrigerant as it returns to the gaseous form. The evaporator 140 that evaporates the reduced-pressure refrigerant received from the expansion device 130 into a gaseous form and performs a heat exchange between the refrigerant and the cold water to further chill the cold water.

The chiller module 100 may also include a first tubing 101 that is provided to the outlet side of the compressor 110 and guides the refrigerant discharged from the compressor 110 to the condenser 120 and a second tubing 102 that is provided to the outlet side of the condenser 120 and guides the liquid refrigerant condensed at the condenser 120 to the expansion device 130.

The cooling water input flow path 42 and the cooling output flow path 44 may be connected to the condenser 120. According to this configuration, the cooling water from chiller 100 is inputted into the condenser 120 through the cooling water input flow path 42, flows through a cooling water flow path formed in the inside of the condenser 120, and then is outputted through the cooling water output flow path 44.

The cold water input flow path 52 and the cold output flow path 54 may be connected to the evaporator 140. According to this configuration, the cold water is inputted into the evaporator through the cold water input flow path 52, flows through the cold water flow path formed in the inside of the evaporator 140, and then is outputted through the cooling water output flow path 54.

In one example, the condenser 120 and the evaporator 140 may be configured as a shell-in-tube heat exchange device capable of exchanging heat between the refrigerant and water. For example, a tube may extend within a shell, and the cooling/cold water may flow inside the tube, and a refrigerant may be received inside the shell and outside the tube. Hereinafter, an internal structure of the evaporator 120 according to one embodiment will be described.

With reference to FIGS. 3 to 6, the condenser 120 may include a shell 121 that forms exterior of the condenser 120. The condenser 120 may also include a refrigerant input port 122 that is formed on one side (or lateral end) of the shell 121 and in which the gaseous refrigerant compressed at the compressor 110 is inputted and a refrigerant output port 123 that is formed at the other side (or other lateral end) of the shell 121 and at which the liquid refrigerant condensed at the condenser 120 is outputted.

Figure 4:
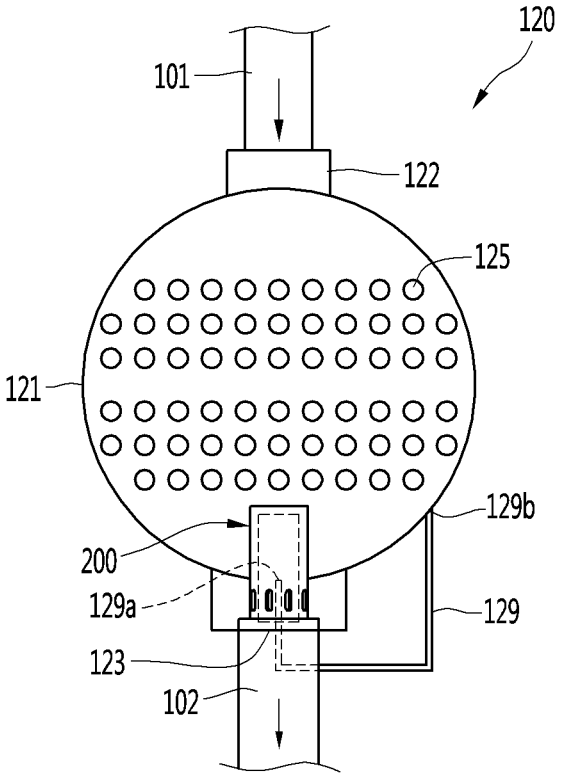
FIG. 4 is a front view illustrating a condenser and a flow rate adjusting device of FIG. 2.

As shown in FIG. 4, the shell 121 may be formed in a cylindrical shape, and a center axis of the shell 121 may be arranged to be perpendicular to a vertical line of the shell. The shell 121 may be divided into an upper half portion and a lower half portion relative to a horizontal line passing through a center axis of the shell 121. In one configuration, widths of the lower half portion and the upper half sections of the shell 121 may increase toward the horizontal center line and decrease moving away from horizontal center line.

Figure 3:
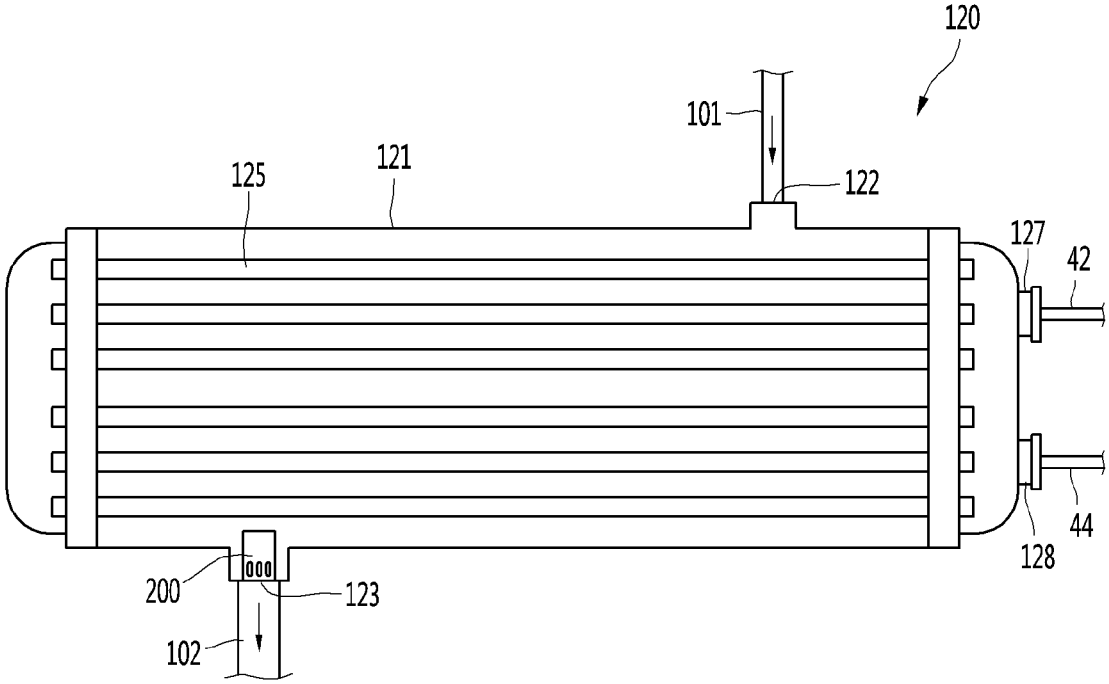
FIG. 3 is a side view illustrating a condenser and a flow rate adjusting device of FIG. 2.

In the example shown in FIGS. 3 and 4, the refrigerant output port 123 may be provided to the lower half portion of the shell 121, and the refrigerant input port 122 may be provided to the upper half portion of the shell 121. According to this configuration, the gaseous refrigerant inputted to the refrigerant input port 122 in the upper half portion of the shell 121, is condensed into a liquid state inside the condenser 120, and the liquid refrigerant drawn by gravity into the lower half portion of the shell 121 to be discharged from condenser 120 through the refrigerant output port 123.

In addition, the condenser 120 may include a cooling water flow path 125 that is provided to the inside of the shell 121 and guides a flow of the cooling water within the condenser 120. The condenser 120 may also include a cooling water input portion 127 that directs the cooling water to the cooling water flow path 125, and a cooling water output portion 128 that causes the cooling water to be output from the cooling water flow path 125. In one example, the cooling water input portion 127 may be formed on one side end of the shell 121, and cooling water output portion 128 may be formed on the other side end of the shell 121. In another example, the cooling water input portion 127 and cooling water output portion 128 may be formed on the same lateral end of the shell 121. The cooling water input portion 127 may be connected to the cooling water input flow path 42 to receive the cooling water, and the cooling water output portion 128 is connected to the cooling output flow path 44 to output the cooling water from condenser 120.

The gaseous refrigerant inputted inside the shell 121 (e.g., via the refrigerant input port 122) may be condensed into liquid state by exchanging heat with the cooling water flow path 125. The liquid refrigerant moves to the refrigerant output port 123. For example, gravity may draw the liquid refrigerant to the lower portion of the shell 121 to be outputted through the refrigerant output port 123.

In one implementation, the condenser 120 may also include a flow rate adjusting device 200 that is provided near to or within the refrigerant output port 123. The flow rate adjusting device 200 may include a main body portion (or first sleeve) 210 and an opening and closing member (or second sleeve) 220 that is received in the main body portion 210.

The flow rate adjusting device 200 functions to maintain the consistent amount the liquid refrigerant (R) within the interior of the condenser 120. For example, if an amount of the liquid refrigerant within the condenser 120 is below a low threshold level, the flow rate adjusting device 200 may slow or even stop the flow of the liquid refrigerant through the refrigerant output port 123. Similarly, if the amount of the liquid refrigerant within the condenser 120 is above a high threshold level, the flow rate adjusting device 200 may increase the flow of the liquid refrigerant through the refrigerant output port 123.

The flow rate adjusting device 200 may be fixed to one side of the refrigerant output port 123. For example, the refrigerant output port 123 may be encased by or otherwise shielded by the main body portion 210. The inner diameter of the main body portion 210 may be greater than an outer diameter of the refrigerant output port 123, and the refrigerant output port 123 may be enclosed by the main body portion 210. According to this configuration, the refrigerant in the shell 121 cannot be outputted through the refrigerant output port 123 without first flowing through the flow rate adjusting device 200.

The main body portion 210 may include at least one flow hole 212, and the liquid refrigerant in shell 121 may flow through the flow hole 212 to reach the refrigerant output port 123. The flow hole 212 can be selectively opened or closed by the opening and closing member 220 to control the flow of the liquid refrigerant from the condenser 120. When the flow hole 212 is opened by the opening and closing member 220, the liquid refrigerant in the inside of the shell 121 may flow inside of the main body portion 210 through the flow hole 212 and then to the refrigerant output port 123. When the flow hole 212 is closed by the opening and closing member 220, the liquid refrigerant cannot reach the refrigerant output port 123 and the liquid refrigerant remains inside the shell 121.

Multiple flow holes 212 may be provided on the main body portion 210. For example, the flow holes 212 may be formed on a lower (e.g., downward) portion of the main body portion 210, and the flow holes 212 may be separated by a prescribed gap. Each of the flow holes 212 may have an elongated circular shaped opening, such as an oval or elliptical shaped opening. For example, the flow hole 212 may be extended in a longitudinal direction of the main body portion 210 (e.g., an axial direction of the cylinder forming the main body portion 210). Since the flow hole 212 is extended in the longitudinal direction of the main body portion 210, the opening area of the flow hole 212 may gradually increase as the opening and closing member 220 is raised from a closed position to expose more of the flow hole 212. Similarly, the opening area of the flow hole 212 may be gradually decreased as the opening and closing member 220 is lowered from an open position. Since the degree that the flow hole 212 is opened can be adjusted to the movement of the opening and closed member 220 can adjust, more precise refrigerant flow rate control may be achieved.

The lower end portion of the main body portion 210 may be in fluid communication with the second tubing 102. For example, the liquid refrigerant inputted into the main body portion 210 through the flow hole 212 may be move through the second tubing 102 to the expansion device 130.

A main body portion cover (or cap) 216 may be provided in an upper side (e.g., opposite the flow hole 212) of the main body portion 210. The main body portion cover 216 shields an opening on the upper end portion of the main body portion 210 so that the liquid refrigerant cannot enter the main body portion 210 through the opening and, instead, can only enter the main body portion 210 through the flow hole 212. The main body portion cover 216 may be separately coupled to the main body portion 210 (e.g., the main body portion cover 216 may be screwed on to the main body portion 210) or the body portion cover 216 may be integrally formed with the main body portion 210 or may be permanently affixed to (e.g., welded on) the main body portion 210.

As previously described, the main body portion 210 may have a substantially cylindrical shape or other shape having a central cavity. The opening and closing member 220 is received in the main body portion 210. For example, an outer peripheral surface of the opening and closing member 220 may be in contact with an inner peripheral surface of the main body portion 210 such that the liquid refrigerant cannot flow in gap between the main body portion 210 and the opening and closing member 220. For example, the outer peripheral surface of the opening and closing member 220 may have shape that corresponds to the inner peripheral surface of the main body portion 210. A central axis of the opening and closing member 220 and a central axis of the main body portion 210 may be arranged to match each other.

An upper and lower distal ends of the opening and closing member 220 may include openings. An opening and closing member cover (or cap) 226 may be provided in the upper distal end of the opening and closing member 220. The opening and closing cover 226 may cover the opening at the upper distal end of the opening and closing portion 220. Consequently, the liquid refrigerant may enter or exit the opening and closing member 220 through the opening in the lower distal end, but may not enter or exit the opening in the upper distal end of the opening and closing member 220. The main body portion cover 226 may be separately coupled to the opening and closing member 220 or may be integrally formed with or permanently attached (e.g., welded) to the opening and closing member 220.

The opening and closing member 220 may move in a sliding manner within the main body portion 210. A length of the opening and closing member 220 may be relatively shorter than a length of the main body portion 210. When the opening and closing member 220 slides down (e.g., toward the refrigerant output port 123), a portion of the opening and closing member 220 may completely overlap the flow hole 212 to close the flow hole 212 and prevent the flow of the refrigerant through the flow holes 212. On the other, when the opening and closing member 220 slides up, the opening and closing member 220 exposes at least a portion of the flow hole 212. The exposed portion of flow holes 212 allows the refrigerant to enter the main body portion 210. In this way, the opening and closing member 220 may be selectively moved up or down to control the flow of refrigerant through the flow holes 212 of the main body portion 210.

The flow adjusting device 200 may include a connecting pin 230 that passes through a main body portion 210, and an opening and closing member 220. A guide portion (or opening) 214 may be formed in the main body portion 210, and a through hole 224 may be formed in the opening and closing member 220. The connecting pin 230 may pass through guide portion 214 and may be inserted in the through hole 224.

Figure 5:
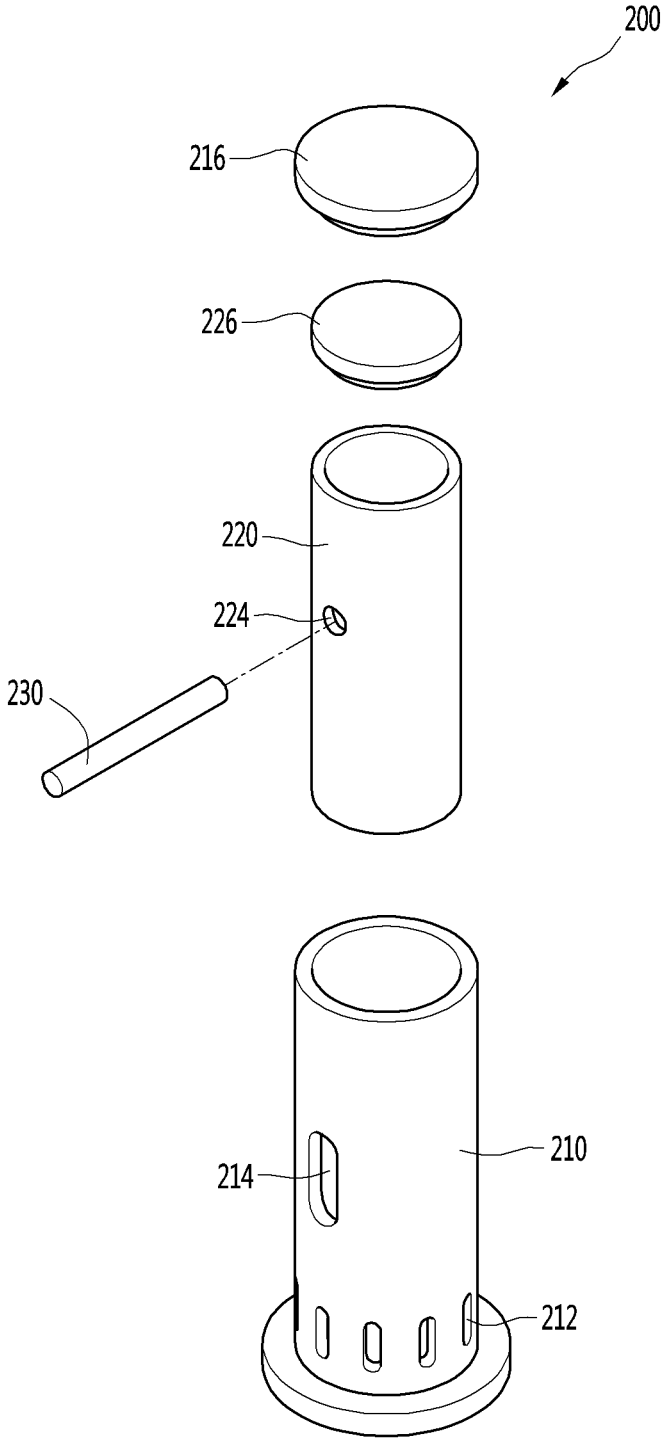
FIG. 5 is an exploded perspective view illustrating a flow rate adjusting device of FIG. 3.
Figure 6:
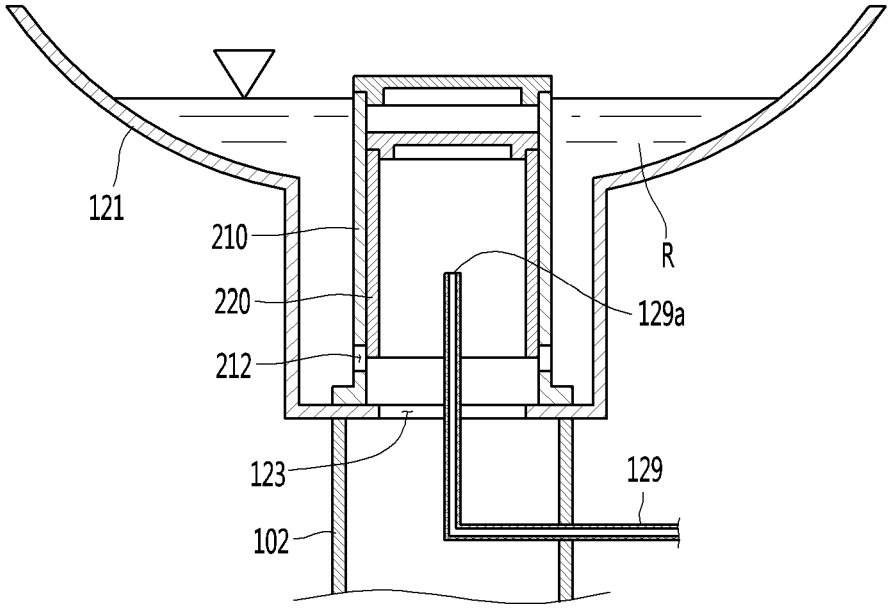
FIG. 6 is a longitudinal sectional view illustrating a condenser and a flow rate adjusting device of FIG. 4.

As shown in FIG. 5, the guide portion 214 may extended a predetermined length along the longitudinal direction of the main body portion 210. For example, the guide portion 214 may have an upper end portion and a lower end portion of the guide portion 214. In one configuration, the guide portion 214 may have an elongated circular shape that is similar to the shape of the flow hole 212.

As previously described, the connecting pin 230 may be inserted through the guide portion 214 and into the through hole 224. The connecting pin 230 may move in the guide portion 214 to guide the movement of the opening and closing member 220. Also, the movement of the connecting pin 230 within the guide portion 214 may restrict the moving range of the opening and closing member 220.

In one implementation, a withdrawal prevention portion (not shown) for preventing the connecting pin 230 from withdrawing from the main body portion 210 and the opening and closing member 220 may be provided in the connecting pin 230. For example, the connecting pin 230 may include a threaded end that is inserted into the guide portion 214 and the through hole 224, and a nut (or other connection mechanism) may be attached to the threaded end to prevent the connecting pin 230 from being removed from the guide portion 214 and the through hole 224.

For example, when the opening and closing member 220 is raised to open the flow hole 212, the connecting pin 230 may interface with an upper portion of the guide portion 214 to limit the range that opening and closing member 220 can be raised. Similarly, when the opening and closing member 220 is lowered to close the flow hole 212, the connecting pin 230 may interface with a lower portion of the guide portion 214 to limit the range that opening and closing member 220 can be lowered. Furthermore, the connecting pin 230 may interface with side portions of the guide portion 214 to limit a rotation of the opening and closing member 220 within the main body portion.

The through hole 224 formed on the side of the opening and closing member 220 may have a size that corresponds to the connecting pin 230. According to this, the connecting pin 230 may be inserted into the through hole 224 to be affixed to the opening and closing member 220. When assembling the flow adjusting device 200, the opening and closing member 220 may inserted into the main body portion 210, and then the connecting pin 230 pass through the guide portion 214 and into the through hole 224. The opening and closing member cover 226 is coupled to the opening and closing member 220, and the main body cover 216 is coupled to the main body portion 210.

Although a single connecting pin 230 and a single pair of the guide portion 214 and the through hole 224 are depicted in FIG. 5, it should be appreciated that the flow rate adjustment device may include two or more pairs of the guide portions 214 and the through holes 224. In one example, pairs of the guide portions 214 and the through holes 224 may be provided at different vertical positions in the main body portion 210 and the opening and closing member 220, and different connecting pin 230 may be inserted into each pair of the guide portions 214 and the through holes 224. In another example, pairs of the guide portions 214 and the through holes 224 may be positioned at different radial portions but at the same height in the main body portion 210 and the opening and closing member 220. For instance, the pair of the guide holes 224 may be disposed so that an imaginary line that connects to the centers of the through holes 224 intersects with the center axis of the opening and closing member 220. According to this, a single connecting pin 230 may be inserted the through pairs of the guide portions 214 and the through holes 224 to intersect the center axis of the opening and closing member 210.

In an example shown in FIGS. 4 and 6-8, the flow adjusting device 200 may further include a refrigerant supply tube 129 that supplies the refrigerant from the inside of the condenser 120 (e.g., within shell 121) to cavity within the main body portion 210. One end (a first end) 129*a* of the refrigerant supply tube 129 may be inserted through the opening and closing member 220 and into the cavity of the main body portion 210, and another end (a second end) 129*b* of the refrigerant supply tube 129 may be connected to the shell 121 of the condenser 120. For example, the other end 129*b* of the refrigerant supply tube 129 may be connected to the lower half portion of the shell 121 such that gravity pulls some of the refrigerant from the shell 121 to the cavity of the main body portion 210. In the example, shown in FIG. 4 in which the shell 121 has a cylindrical shape, the width of the shell 121 may increase away from the flow adjusting device 200 and toward the horizontal middle of the shell 121. In this configuration, the liquid refrigerant is collected to the upper side of the other end 129*b* of the refrigerant supply tube 129 and then may be input to the other end 129*a* of the refrigerant supply tube 129. Thus, the liquid refrigerant in the inside of the shell 121 may be carried by the refrigerant supply tube 129 to the internal cavity of the main body portion 210 and to the flow rate adjustment device.

The liquid refrigerant in the inside of the condenser 120 may be selectively inputted to the refrigerant supply tube 129 according to the level of liquid refrigerant within the shell, and according to this selectively movement of the fluid refrigerant through the refrigerant supply tube 129, the flow adjusting device 200 may be operated. The operating principle of the flow adjusting device is now described with respect to FIGS. 7 and 8.

Figure 7:
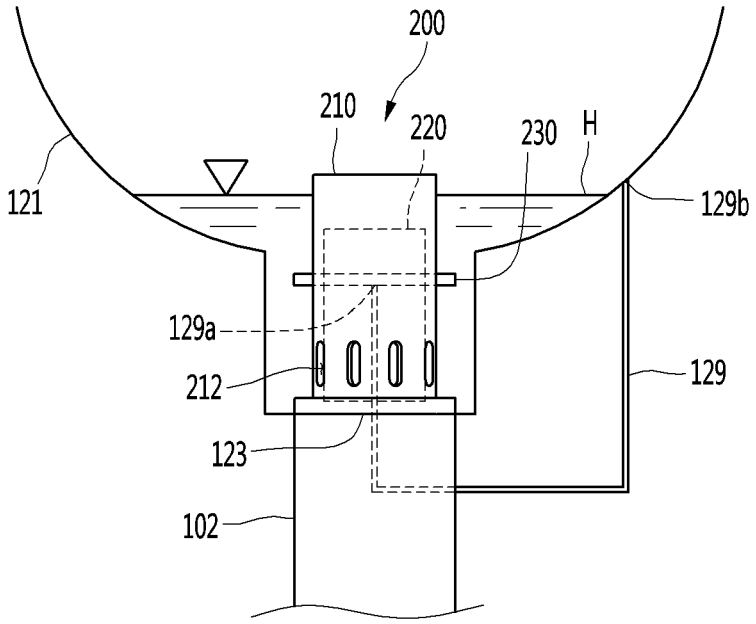
FIG. 7 is a view illustrating a case where a liquid refrigerant is properly collected in the inside of the condenser.
Figure 8:
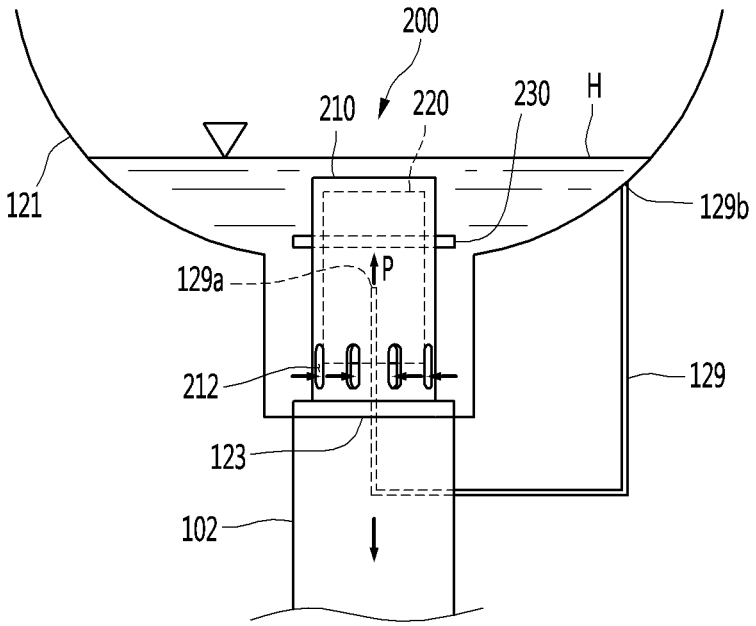
FIG. 8 is a view illustrating a case where amount of a liquid refrigerant is excessively collected in the inside of the condenser.

FIG. 7 is a view illustrating a case where a liquid refrigerant is at a desired level within the condenser 120, and FIG. 8 is a view illustrating a case where the quantity of the liquid refrigerant in the condenser 120 exceeds the desired level. With reference to FIGS. 7 and 8, the flow adjusting device 200 closes to prevent the liquid refrigerant from moving to the second tubing 102 when a level (or height (H)) of the liquid refrigerant in the the shell 121 of the condenser 120 is lower than or equal to a predetermined level and opens to allow some of the liquid refrigerant to move to the second tubing 102 when the level (H) is higher than or equal to the predetermined level. As used herein, the level (H) of the liquid refrigerant may refer to a height of the liquid refrigerant collected in the inside of the shell 121. For example, the level (H) may refer to the vertical distance from an opening of the refrigerant output port 123 to an upper surface of the liquid refrigerant within the shell 121.

As previously described, the first end 129*a* of the liquid supply tube 129 may be inserted inside the opening and closing member 220, and the second end 129*b* of the liquid supply tube 129 may be inserted inside the shell 121. Some of the refrigerant in the inside of the shell 121 may be transported to the opening and closing member 220 through the refrigerant supply tube 129. For example, when the height H of the liquid refrigerant in the inside of the shell 121 is lower than the other end 129*b* of the refrigerant supply tube 129 (i.e., the other end 129*b* is above the fluid refrigerant), gaseous refrigerant in the shell 121 may be transported inside of the opening and closing member 220 through the refrigerant supply tube 129. The internal pressure applied to the opening and closing member 220 (e.g., via the gaseous refrigerant) is smaller than the weight of the opening and closing member 220, and the opening and closing member 220 is lowered. The lowered opening and closing member 220 blocks the flow hole 212 to prevent the liquid refrigerant from exiting the shell 121. While the flow hole 212 is closed, more liquid refrigerant is collected in the shell 121, and thus, the level H of the liquid refrigerant increases.

When the level H of the liquid refrigerant sufficiently increases to be higher than the other end 129*b* of the refrigerant supply tube 129, liquid refrigerant from the shell 121 is transported to the inside of the opening and closing member 220 through the liquid supply tube 129*b*. The liquid refrigerant injected by the liquid supply tube 129 provide sufficient pressure (P) against the opening and closing member cover 226 to raise the opening and closing member 220. When the opening and closing member 220 is raised sufficiently to expose a portion of the flow hole 212, the exposed portion of the flow hole 212 allows the liquid refrigerant to leave the condenser 120 via the refrigerant output port 123.

The pressure of the liquid refrigerant that is injected through the refrigerant supply tube 129 may increase as the level H of the liquid refrigerant in the shell 121 increases. Thus, increased pressure (P) may be applied to the opening and closing member 220 as the height H of the liquid refrigerant in the shell 121 increases, and the opening and closing member 220 may be raised more based on the increased pressure. Similarly, less pressure (P) may be applied to the opening and closing member 220 when the height H of the liquid refrigerant in the shell 121 decreases, and the opening and closing member 220 may be lowered due to the decreased pressure.

Since the flow hole 212 has an elongated circular shape, the extent that the flow hole 212 is open may be adjusted according to the height that the opening and closing member 220. Accordingly, the flow hole 212 opens more as the amount of the liquid refrigerant in the inside of the shell 121 is increased, the discharging rate of the liquid refrigerant through the flow adjusting device 200 is increased to correspond to increasing amount of the liquid refrigerant in the shell 121.

The opened flow holes 212 allows more liquid refrigerant to leave the condenser 120. As more of the liquid refrigerant in the inside of the shell 121 is moved to the expansion device 130 through the second tubing 102, the water level H of the liquid refrigerant in the inside of the shell 121 is reduced. When the level H of the liquid refrigerant is reduced and the pressure P applied by the refrigerant supply tube 129 against the opening and closing member 220 is reduced, and the opening and closing member 220 again is lowered and to at least partially close the flow hole 212 and slow the flow of the liquid refrigerant from the condenser 120.

Consequently, the flow adjusting device 200 may be adjusted so that the level H of the liquid refrigerant inside the shell 121 is maintained near the height of the end 129*b* of the refrigerant supply tube 129. The level H of the liquid refrigerant maintained in the shell 121 may be changed by adjusting the height of the end 129*b* within the condenser 120.

Thus, the level of the liquid refrigerant in the inside of the condenser is maintained at a predetermined height by the flow adjusting device. Also, the chiller system of the present disclosure can solve control stability problem since the chiller system of the present disclosure does not use electronic devices, such as a sensor and a control unit for the refrigerant flow rate control.

In addition, it is possible to more accurate refrigerant flow rate control by the flow hole that is formed in the flow adjusting device having the long hole shape. In addition, the opening and closing member may be stably operated by providing the guide portion that guides movement of the opening and closing member to flow adjusting device.

A chiller system having a flow adjusting device that is constantly capable of maintaining a level of the liquid refrigerant of a condenser through a mechanical method is provided. In the provided chiller system, the flow adjusting device is operated in a stable manner. The liquid refrigerant discharging rate of the flow adjusting device may be adjusted to correspond to the increasing rate of the liquid refrigerant in the inside of the condenser for constantly maintaining the level of the liquid refrigerant of the condenser.

In order to constantly maintain the level of the liquid refrigerant of the condenser through a mechanical method, the chiller system of the present disclosure may include a flow adjusting device that is provided to a refrigerant output port side of the condenser, and the flow adjusting device has a flow hole in which refrigerant is selectively input, and the flow hole is communicated with tubing of the condenser outlet side, and the condenser has a refrigerant supply tube that one end thereof is inserted into the inside of the flow adjusting device and the other end thereof is connected to one point of the condenser, and thus the liquid refrigerant in the inside of the condenser according to height of the liquid refrigerant collected in the condenser is selectively input to the flow adjusting device through the refrigerant supply tube and the amount of the liquid refrigerant in the inside of the condenser is adjusted by selectively opening and closing the flow hole according to the pressure of the liquid refrigerant input through the refrigerant supply tube.

In order to reliably operate the flow adjusting device, the flow adjusting device may include a connecting pin that passes through the main body portion and the opening and the closing member in turn, the connecting pin is fixed to the opening and closing member and is relatively moved to the main body portion, the guide portion into which the connecting pin is inserted is formed in the main body portion, and the guide portion has a long hole shape that extends according to longitudinal direction of the main body portion. In order to adjust the discharging rate of the liquid refrigerant to correspond to the increasing rate of the liquid refrigerant in the inside of condenser, the flow hole has a long hole shape that extends according to longitudinal direction of the main body portion, Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A chiller system, comprising:

a compressor to compress refrigerant;

a condenser that exchanges heat between the refrigerant discharged from the compressor and a cooling water; and a flow adjusting valve that is provided to a refrigerant output port of the condenser and adjusts an amount of refrigerant inside the condenser, wherein the flow adjusting valve includes: a main body provided at the refrigerant output port;

a refrigerant supply tube that extends to the main body from the condenser and supplies the refrigerant inside the condenser to an inside of the main body; and a flow hole formed on the main body and selectively opened and closed according to a pressure of the refrigerant inside the refrigerant supply tube, wherein the flow adjusting valve further includes:

an opening and closing member that is provided inside of the main body to selectively open and close the flow hole, wherein a first end of the refrigerant supply tube is inserted into the opening and closing member, and a second end of the refrigerant supply tube is inserted into the condenser at a prescribed position, and wherein the refrigerant flows to the first end from the second end of the refrigerant supply tube and is discharged into the inside of the main body.

2. The chiller system of claim 1, wherein when the pressure of the refrigerant inside the refrigerant supply tube is greater than a threshold amount, the flow hole is opened and the refrigerant inside the condenser flows in the main body through the opened flow hole.

3. The chiller system of claim 1, wherein when a top surface of a liquid refrigerant collected inside the condenser is higher than the prescribed position of the second end of the refrigerant supply tube, the flow of the refrigerant through the refrigerant supply tube causes the opening and closing member to move and open the flow hole.

4. The chiller system of claim 1, wherein when a top surface of a liquid refrigerant collected inside the condenser is lower than the prescribed position of the second other end of the refrigerant supply tube, the opening and closing member is moved to block a flow of the refrigerant through the flow hole.

5. The chiller system of claim 1, wherein the flow adjusting valve further includes a connecting pin that is inserted through an opening in the main body and is coupled to the opening and closing member, and wherein the connecting pin moves relative to the main body based on a movement of the opening and closing member.

6. The chiller system of claim 5, wherein the opening in the main body has an oval shape that extends along a longitudinal direction of the main body, and wherein the connecting pin moves within the opening to cause the opening and closing member to move within the main body along the longitudinal direction.

7. The chiller system of claim 6, wherein the opening includes an upper edge that engages the connecting pin when the flow hole is opened; and wherein the opening includes a lower edge that engages the connecting pin when the flow hole is closed.

8. The chiller system of claim 1, wherein the flow hole has an oval shape and extends along a longitudinal axis of the main body.

9. The chiller system of claim 8, wherein a portion of the flow hole that is opened to pass the refrigerant into the inside of the main body increases as the opening and closing member moves in a first direction along the longitudinal axis, and wherein the portion of the flow hole that is opened decreases as the opening and closing member moves in a second direction along the longitudinal axis that is opposite the first direction.

10. The chiller system of claim 1, wherein each of the main body and the opening and closing member has an opened upper end and a cover that shields the opened upper end.

11. The chiller system of claim 1, wherein the refrigerant output port is shielded by the main body, and wherein the refrigerant inside the condenser moves to the refrigerant output port through the flow hole when the flow hole is opened by the opening and closing member.

12. The chiller system of claim 1, wherein a lower half portion of the condenser has a shape with a width that increases away from the refrigerant output port, and wherein the second end of the refrigerant supply tube is connected to the lower half portion of the condenser.

13. A chiller system having a condenser that receives a refrigerant from a compressor, and a flow control valve that controls a flow of the refrigerant from the condenser, wherein the flow control valve comprises:

a first sleeve coupled to an output port of the condenser, wherein the first sleeve includes an interior space in fluid communication with the output port, and wherein the first sleeve prevents the refrigerant from entering the output port without first passing into the interior space;

a refrigerant supply tube that extends between an interior of the condenser and the interior space of the first sleeve and is configured to provide the flow of the refrigerant from the interior of the condenser to the interior space of the first sleeve;

a second sleeve provided in the first sleeve, wherein the second sleeve moves within the first sleeve based on the flow of the refrigerant through the refrigerant supply tube; and a flow hole provided on the first sleeve, wherein the flow hole is selectively opened or closed based on a movement of the second sleeve in the first sleeve, and wherein the flow hole, when opened, allows a liquid refrigerant from the condenser to enter the interior space of the first sleeve, wherein a first end of the refrigerant supply tube is inserted into the interior space of the second sleeve and a second end of the refrigerant supply tube is inserted into the condenser at a prescribed position, and wherein the refrigerant flows to the first end from the second end to be discharged into the interior space of the first sleeve, wherein when a top surface of the liquid refrigerant collected in the condenser is higher than the prescribed position of the second end of the refrigerant supply tube the liquid refrigerant flows through the refrigerant supply tube and into the interior space of the first sleeve, and wherein when the top surface of the liquid refrigerant collected in the condenser is lower than the prescribed position of the second end of the refrigerant supply tube, a gaseous refrigerant flows through the refrigerant supply tube and into the interior space of the first sleeve.

14. The chiller system of claim 13, wherein the second sleeve moves to open the flow hole when the liquid refrigerant flows through the refrigerant supply tube, and the second sleeve moves to close the flow hole when the gaseous refrigerant flows through the refrigerant supply tube.

15. The chiller system of claim 13, wherein the second sleeve moves within the first sleeve based on a pressure associated with the flow of the refrigerant through the refrigerant supply tube, and wherein the pressure associated with the flow of the refrigerant through the refrigerant supply tube varies based on an amount of the liquid refrigerant within the condenser.

16. A chiller system having a compressor and a condenser, the condenser including:

an input port configured to receive a refrigerant from the compressor, an output port configured to output the refrigerant from the condenser; and a flow control valve that includes:

a first sleeve coupled to the output port, wherein the first sleeve includes an interior space in fluid communication with the output port;

a refrigerant supply tube that extends between an inside of the condenser and the interior space of the first sleeve and is configured to provide a flow of the refrigerant from the inside of the condenser to the interior space of the first sleeve; and a flow hole provided on the first sleeve, wherein the flow hole is selectively opened or closed based on the flow of the refrigerant through the refrigerant supply tube, and wherein the flow hole, when opened, allows the refrigerant from the inside of the condenser to enter the output port, wherein the flow adjusting valve further includes:

an opening and closing member that is provided inside of the first sleeve to selectively open and close the flow hole, wherein a first end of the refrigerant supply tube is inserted into the opening and closing member and a second end of the refrigerant supply tube is inserted into the condenser at a prescribed position, and wherein the refrigerant flows to the first end from the second end of the refrigerant supply tube and is discharged into the inside of the first sleeve.

* * * * *